US008811878B2

(12) United States Patent
Egusa et al.

(10) Patent No.: US 8,811,878 B2
(45) Date of Patent: Aug. 19, 2014

(54) FIXING DEVICE AND IMAGE FORMING APPARATUS

(75) Inventors: Naoyuki Egusa, Kanagawa (JP); Tetsuro Kodera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 139 days.

(21) Appl. No.: 13/553,181

(22) Filed: Jul. 19, 2012

(65) Prior Publication Data

US 2013/0243502 A1 Sep. 19, 2013

(30) Foreign Application Priority Data

Mar. 13, 2012 (JP) ..... 2012-056039

(51) Int. Cl.
*G03G 15/20* (2006.01)

(52) U.S. Cl.
USPC ..... 399/336; 399/337

(58) Field of Classification Search
CPC ..... G03G 15/2007; G03G 15/201; G03G 2215/2003
USPC ..... 399/69, 336, 337; 430/124.4
See application file for complete search history.

(56) References Cited

U.S. PATENT DOCUMENTS 5,448,344 A * 9/1995 Itakura et al. ..... 399/336
8,249,493 B2 * 8/2012 Matsubara et al. ..... 399/336
8,260,185 B2 * 9/2012 Matsubara et al. ..... 399/336
8,306,468 B2 * 11/2012 Matsubara et al. ..... 399/335
8,403,494 B2 * 3/2013 Kojima et al. ..... 353/38
8,406,669 B2 * 3/2013 Egusa et al. ..... 399/335
8,412,067 B2 * 4/2013 Watanabe et al. ..... 399/92
8,433,231 B2 * 4/2013 Tanaka et al. ..... 399/336
8,452,220 B2 * 5/2013 Kagawa ..... 399/336
8,577,272 B2 * 11/2013 Matsubara et al. ..... 399/336
8,718,527 B2 * 5/2014 Kageyama ..... 399/336
2010/0033686 A1 * 2/2010 Kojima et al. ..... 353/38
2011/0038653 A1 * 2/2011 Egusa et al. ..... 399/336
2011/0044740 A1 2/2011 Matsubara et al.
2011/0044741 A1 * 2/2011 Matsubara et al. ..... 399/335
2011/0103816 A1 * 5/2011 Mitsuoka ..... 399/67
2011/0116851 A1 * 5/2011 Tanaka et al. ..... 399/336
2012/0207500 A1 * 8/2012 Kodera et al. ..... 399/67

FOREIGN PATENT DOCUMENTS

JP A-2002-184206 6/2002
JP A-2009-259711 11/2009
JP A-2011-43609 3/2011
JP A-2011-217235 10/2011

* cited by examiner

*Primary Examiner* — David Gray
*Assistant Examiner* — Carla Therrien
(74) *Attorney, Agent, or Firm* — Oliff PLC

(57) ABSTRACT

A fixing device includes a first radiating portion that includes plural light sources arranged along a first direction at a determined interval, and radiates light on a recording medium on which a toner image is formed and which is transported in a second direction intersecting with the first direction, and an optical member that includes plural transmission regions through which the light radiated by the plural light sources is transmitted and includes plural light diffusion portions diffusing the light in the first direction on each of the plural transmission regions.

19 Claims, 14 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-056039 filed Mar. 13, 2012.

BACKGROUND (i) Technical Field

The present invention relates to a fixing device and an image forming apparatus.

(ii) Related Art

A fixing device is known in which a laser light radiates a recording medium on which a toner image is formed and the toner is fixed on the recording medium. In the fixing device, a laser array is used in which plural semiconductor lasers radiating the laser light are arranged.

SUMMARY

According to an aspect of the present invention, there is provided a fixing device including: a first radiating portion that includes plural light sources arranged along a first direction at a determined interval, and radiates light on a recording medium on which a toner image is formed and which is transported in a second direction intersecting with the first direction; and an optical member that includes plural transmission regions through which the light radiated by the plural light sources is transmitted and includes plural light diffusion portions diffusing the light in the first direction on each of the plural transmission regions.

BRIEF DESCRIPTION OF THE DRAWINGS

Exemplary embodiments of the present invention will be described in detail based on the following figures, wherein.

DETAILED DESCRIPTION

Figure 1:
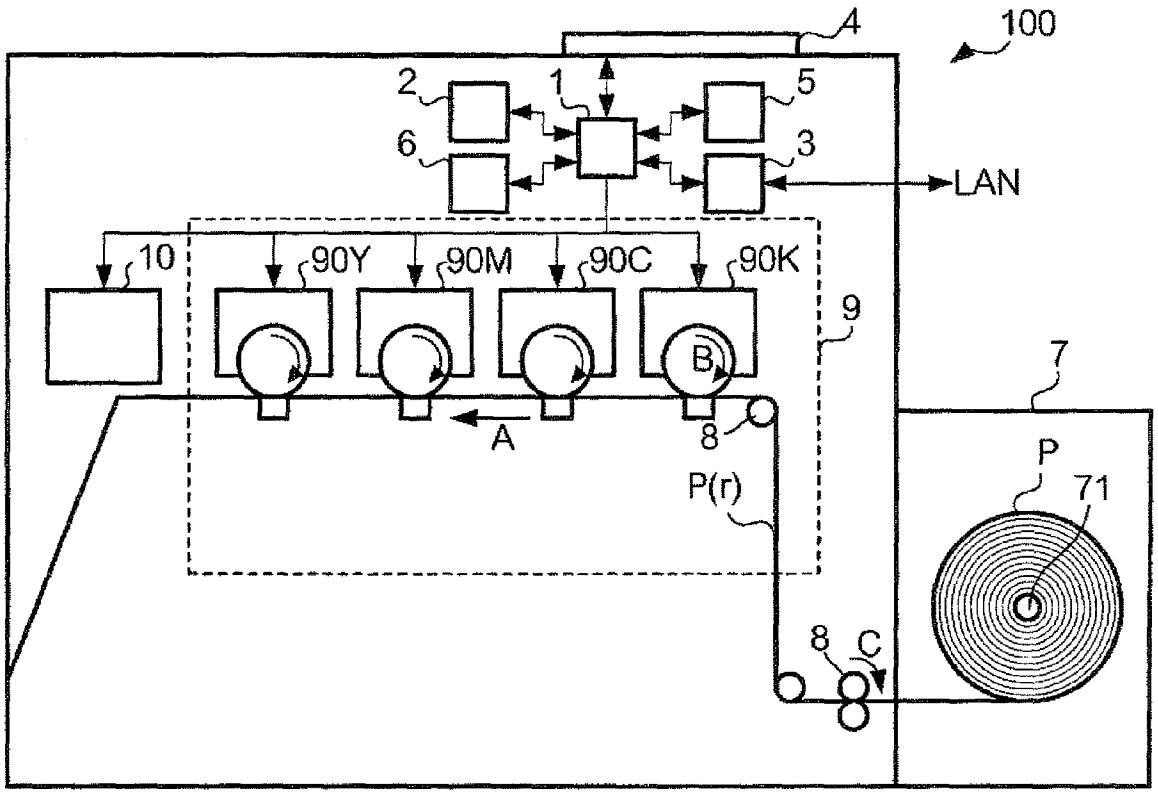
FIG. 1 is a schematic view showing a hardware configuration of an image forming apparatus.

FIG. 1 is a schematic view showing a hardware configuration of an image forming apparatus 100 according to an exemplary embodiment of the present invention. The image forming apparatus 100 includes a controller 1, a memory 2, a communication portion 3, a receiving portion 4, an imaging reading portion 5, an image processing portion 6, a storing portion 7, a transport roll 8, an image forming portion 9, and a fixing device 10 in the inner portion of a housing. The controller 1 controls an operation of each portion of the image forming apparatus 100. The controller 1 includes a CPU (Central Processing Unit), a ROM (Read Only Memory), and a RAM (Random Access Memory). The memory 2 includes a device which stores data and programs used by the controller 1, for example, a HDD (Hard Disk Drive). The communication portion 3 is connected to an external device such as a personal computer or a facsimile machine, and sends and receives image data. The receiving portion 4 receives an input of an instruction from a user. The receiving portion 4 includes an operational unit by which the user inputs the instruction to the image forming apparatus 100. The instruction received through the receiving portion 4 is sent to the controller 1, and the controller 1 controls the operation of the image forming apparatus 100 in accordance with the instruction. The image reading portion 5 optically reads a document and generates image signals. Specifically, the image reading portion 5 includes a platen glass, a light source, an optical system, and an image device (all not shown). The light source radiates the light with respect to the document placed on the platen glass, the light reflected by the document is split into red, green, and blue via the optical system, and the split light enters the image device. The imaging device converts the entered light into image signals, and the image signals are supplied to the image processing portion 6. The image processing portion 6 performs an A/D conversion on the image signals that are supplied from the image reading portion 5, a noise reduction, a gamma correction, a conversion from R(red), G(green) B(blue) to Y(yellow), M(magenta), C(cyan), and K(black), a screen processing, and the like. In this way, the image data representing gradations of every color and every pixel are generated.

The storing portion 7 stores sheet-like paper P. The paper P is a continuous paper (referred to as "continuous form" or "continuous form paper") that is not cut into single pages, and is stored in a state of being wound around a shaft 71. In addition, when the paper P is divided at perforations for each page, the storing portion 7 may be configured so that the paper is stored in a state of being folded in a zigzag manner along the perforated surfaces. The transport roll 8 transports the paper P along a transport path r. In addition to the shown one, plural transport rolls 8 are provided on the transport path r. The image forming portion 9 (an example of the transfer portion) includes image forming processing units 90Y, 90M, 90C, and 90K. The image forming processing units 90Y, 90M, 90C, and 90K repeatedly transfer the toner image of each of yellow, magenta, cyan, and black to the surface of the paper P according to an electrographic method based on the image data supplied from the image processing portion 6. Since the configuration of each of the image forming processing units is common, hereinafter, when it is not necessary to distinguish each of the image forming processing units, the image forming processing units are collectively referred to as the image forming processing unit 90. In addition, also with respect to the component of the image forming processing unit 90, the notation such as Y, M, C, and K is omitted. The fixing device 10 fixes the toner image transferred by the image forming portion 9 to the paper P. The paper P on which the toner image is fixed is discharged to the outside of the image forming apparatus 100. For example, the discharged paper P is cut for each page by a cutting device (not shown). Hereinafter, the direction (direction of an arrow A) in which the paper P is transported is simply referred to as a "transporting direction" (an example of a first direction), and a direction (direction perpendicular to a paper surface of FIG. 1) perpendicular to the transporting direction is referred to as a "width direction" (an example of a second direction).

Figure 2:
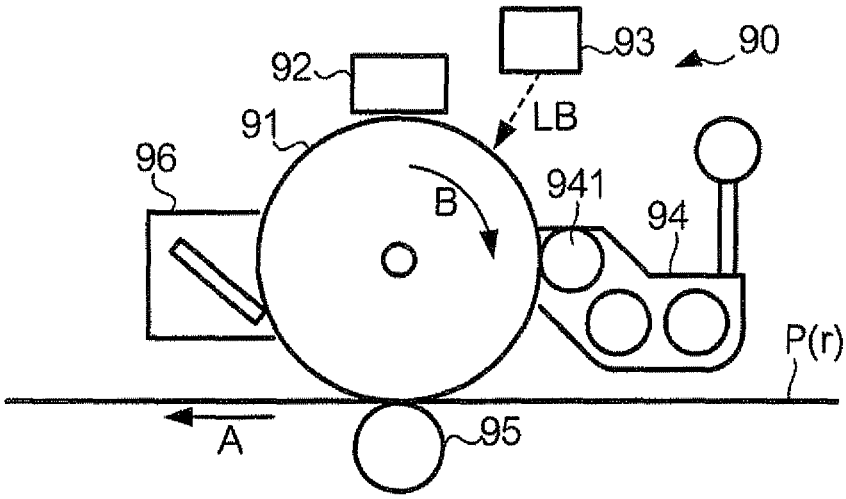
FIG. 2 is a schematic view of an image forming processing unit when viewed from one side in a width direction.

FIG. 2 is a schematic view of the image forming processing unit 90 when viewed from one side in the width direction. The image forming processing unit 90 includes a photoconductor drum 91, a charging device 92, an exposure device 93, a developing device 94, a transfer device 95, and a cleaner 96. The photoconductor drum 91 is a cylindrical member in which a photoconductor film is laminated around the outer circumferential surface thereof, and is supported so as to rotate in a direction of an arrow B with the center of the cylinder as an axis. For example, the charging device 92 may be a scorotron charger and charge the photoconductive film of the photoconductor drum 91 to a potential which is predetermined. The exposure device 93 exposes the photoconductor drum 91 charged by the charging device 92 and forms an electrostatic latent image. Specifically, laser light LB corresponding to the gradation of each pixel representing the image data which are supplied from the image processing portion 6 is generated, and the laser light LB scans the photoconductive film of the photoconductor drum 91 in the width direction. The photoconductor drum 91 rotates in the direction of the arrow B, and writing of the electrostatic latent image at a scan line unit in the width direction is repeated in the transporting direction.

The developing device 94 develops the electrostatic latent image formed on the photoconductor drum 91. The developing device 94 includes a development roller 941 which is provided so as to be opposite to the outer circumferential surface of the photoconductor drum 91. A two-component developer including the toner and a carrier is accommodated in the inner portion of the developing device 94. The toner is one in which powder made of resin is colored with any one color material of yellow, magenta, cyan, and black. The carrier is a powder that is manufactured by a magnetic material. The two-component developer is attached to the outer circumferential surface of the development roller 941, which is driven to rotate, through a magnetic force. A developing bias having a reverse polarity to the electrostatic latent image is applied to the development roller 941. If the toner is charged so as to have a reverse polarity to the electrostatic latent image by the developing bias, the toner moves on the electrostatic latent image and the toner image is formed. The transfer device 95 is a cylindrical member that is opposite to the photoconductor drum 91 while interposing the transport path r. A transfer bias having a reverse polarity to the toner image is applied to the transfer device 95. If the paper P is charged so as to have a reverse polarity to the toner image by the transfer bias, the toner image is transferred to the paper P. If the paper P passes through the image forming processing units 90K, 90C, 90M, and 90Y, the toner image is repeatedly transferred. The cleaner 96 removes the toner remaining on the surface of the photoconductor drum 91 after the toner image is transferred.

Figure 3:
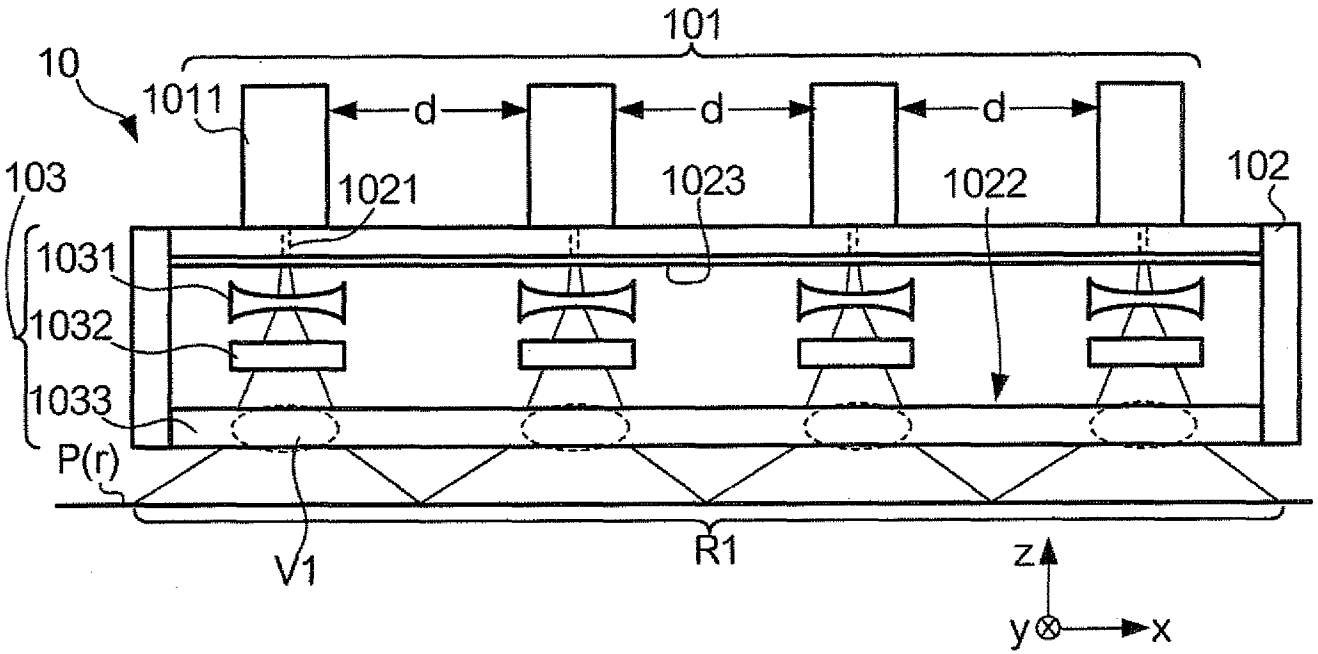
FIG. 3 is a cross-sectional view of a fixing device when viewed from an upstream side in a transporting direction.
Figure 4:
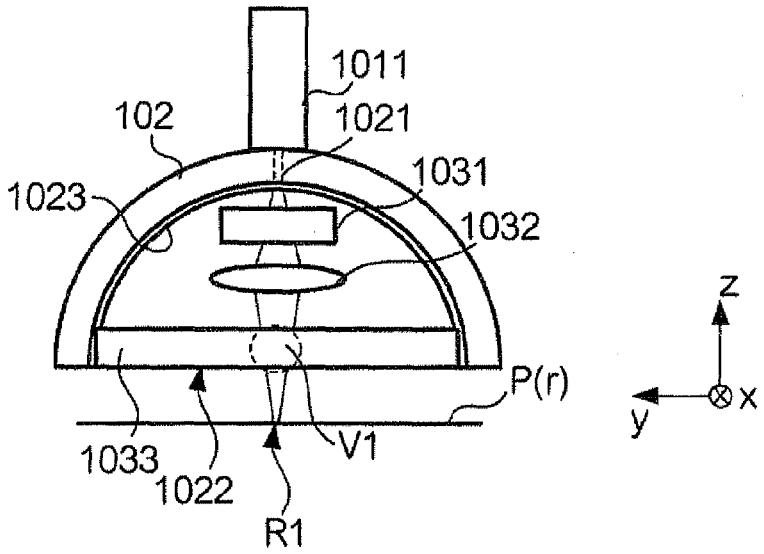
FIG. 4 is a view of the fixing device when viewed from one side in the width direction.

FIG. 3 is a cross-sectional view of the fixing device 10 of an exemplary embodiment of the present invention when viewed from the upstream side in the transporting direction. FIG. 4 is a view of the fixing device 10 when viewed from one side in the width direction. An x axis indicates the width direction, a y axis indicates the transporting direction, and a z axis indicates a height direction. The fixing device 10 includes a radiating portion 101, a housing 102, and an optical system 103. The radiating portion 101 (an example of a first radiating portion) radiates the laser light LB on the paper P which is transferred through the transport roll 8. The radiating portion 101 includes plural light sources 1011 that generate the laser light LB. The light sources 1011 are arranged at an interval d along the width direction. The interval d is determined so that the laser light LB radiates the region on which the toner image of the paper P is formed. In the example shown in FIG. 3, the radiating portion 101 includes four light sources 1011. A wavelength of the laser light LB may be any wavelength if applying sufficient energy to melt the toner to the paper P, and preferably is infrared rays. In this case, toner to which a material absorbing the infrared rays is mixed is used in the developing device 94.

In the housing 102, a cross-section having the transporting direction as a normal direction is formed in a rectangular shape, and a cross-section having the width direction as a normal direction is formed in an arch shape. The optical system 103 is received in the inner portion of the housing 102. The housing 102 supports the optical system 103 by a supporting member (not shown). In addition, the light sources 1011 are supported on the outer surface of the housing 102. The housing 102 is provided with holes 1021, an opening 1022, and a reflective surface 1023. The laser light LB that is radiated from the light sources 1011 passes through holes 1021. The opening 1022 is opposite to the transport path r, and the laser light LB propagating the inner portion of the housing 102 passes through the opening 1022. The laser light LB passing through the opening 1022 reaches the paper P. However, the laser light LB is reflected on the surface of the paper P at a region on which the toner particles are attached. Since not only a mirror reflection but also a diffusion reflection are generated on the surface of the paper P, reflection in all directions may be generated. Moreover, the light that is reflected by the paper P passes through the opening 1022. The reflective surface 1023 is a surface that is opposite to the transport path r in the inside of the housing 102. The reflective surface 1023 reflects the reflected light passing through the opening 1022 to the paper P. A processing for reflecting the laser light LB is performed on the reflective surface 1023. For example, the housing 102 is made of a metal such as aluminum, the reflective surface 1023 may be polished to a mirror surface, and plating such as silver may be performed on the reflective surface 1023. The reflected light is reflected at the reflective surface 1023, and therefore, a portion of the reflected light is absorbed by the toner particles and the remainder is reflected at the surface of the paper P again. In this way, if the reflection of the laser light LB is repeated at the surface of the paper P and the reflective surface 1023 of the housing 102, a portion of the laser light LB reflected at the reflective surface 1023 is absorbed by the toner and promotes the heating and melting of the toner.

The optical system 103 includes luminous flux diffusing members 1031, luminous flux converging members 1032, and an optical member 1033. Each of the luminous flux diffusing members 1031 and the luminous flux converging members 1032 is provided to each single light source 1011 in a one-to-one correspondence. In the example shown in FIG. 3, four luminous flux diffusing members 1031 and four luminous flux converging members 1032 are provided so as to correspond to each of four light sources 1011. The laser light LB radiated from the light sources 1011 propagates toward the luminous flux diffusing members 1031. The luminous flux diffusing members 1031 and the luminous flux converging members 1032 control the propagating direction of the laser light LB that is radiated from the light source 1011. As shown in FIG. 3, in the luminous flux diffusing members 1031, the cross-sections having the transporting direction as a normal direction are formed in a concave shape. The luminous flux diffusing members 1031 diffuse the laser light LB radiated from the light sources 1011 in the width direction. In addition, as shown in FIG. 4, in the luminous flux diffusing members 1031, the cross-sections having the width direction as a normal direction are formed in a rectangular shape. Therefore, the laser light LB transmits through the luminous flux diffusing members 1031 without being refracted in the transporting direction. The laser light LB that is transmitted through the luminous flux diffusing members 1031 propagates toward the luminous flux converging members 1032. As shown in FIG. 4, in the luminous flux converging members 1032, the cross-sections having the width direction as a normal direction are formed in a convex shape. The luminous flux converging members 1032 converge the laser light LB in the transporting direction. In addition, as shown in FIG. 3, in the luminous flux converging members 1032, the cross-sections having the transporting direction as a normal direction are formed in a rectangular shape. Therefore, the laser light LB is transmitted through the luminous flux converging members 1032 without being refracted in the width direction. In this way, the laser light LB is transmitted through the luminous flux diffusing members 1031 and the luminous flux converging members 1032, and therefore, the laser light is diffused in the width direction and converged in the transporting direction. If the laser light LB is transmitted through the luminous flux converging members 1032, the laser light propagates toward the optical members 1033. A height from the transport path r to the optical members 1033 is several millimeters to several centimeters, and dirt such as dust or the toner may be attached thereto.

Figure 5:
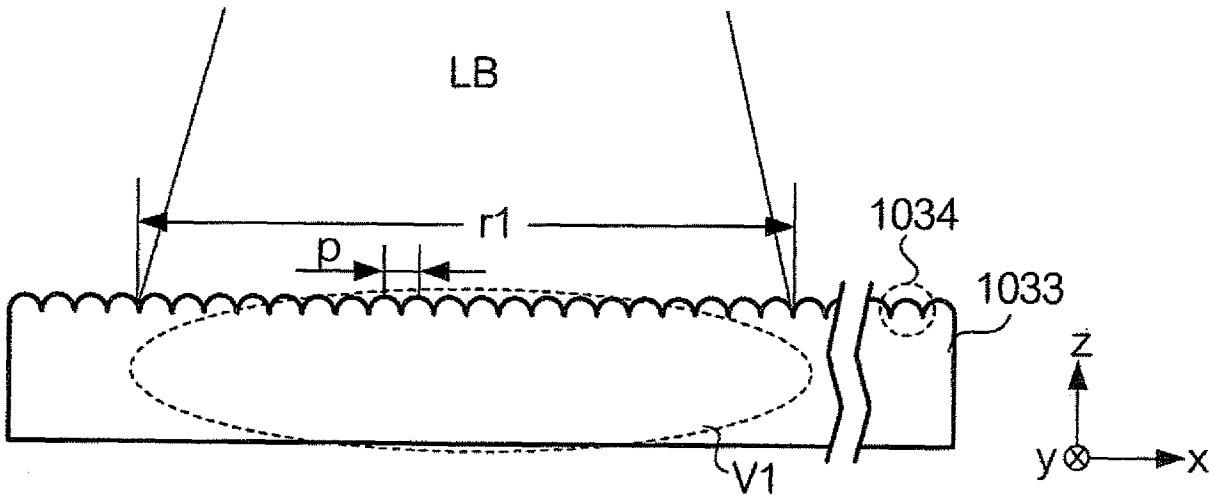
FIG. 5 is an enlarged view of a cross-section having a transporting direction of an optical member as a normal direction.
Figure 6:
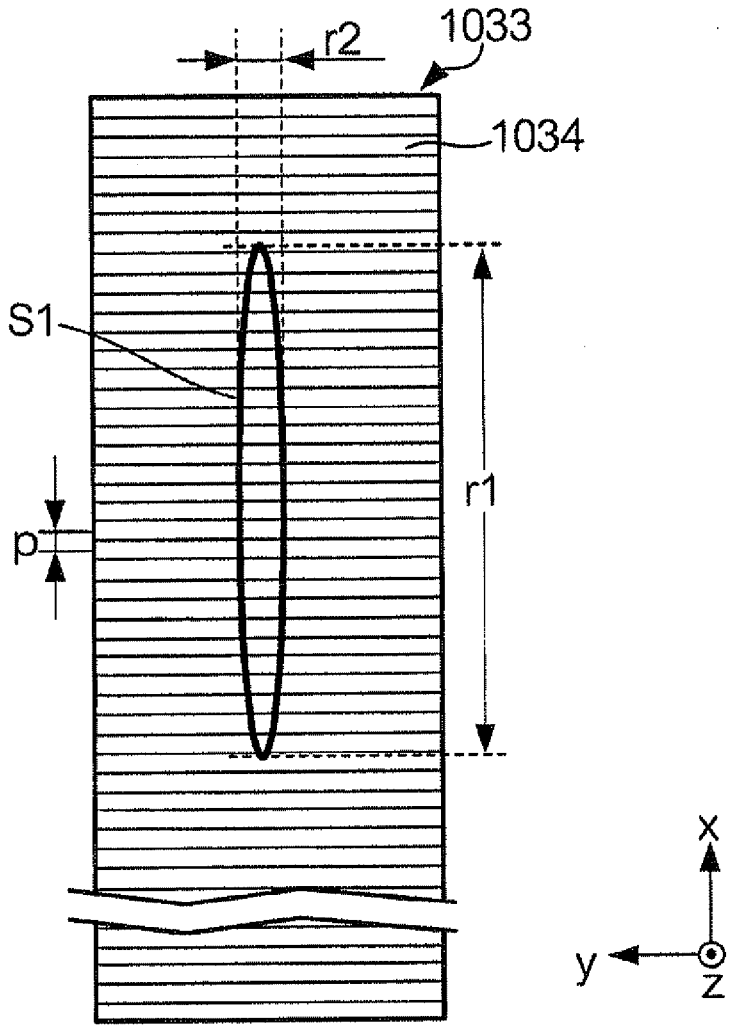
FIG. 6 is an enlarged view of the surface of the optical member when viewed from a radiating portion side.

FIG. 5 is an enlarged view of a cross-section having the transporting direction of the optical members 1033 as a normal direction. FIG. 6 is an enlarged view of the optical members 1033 when viewed from the radiating portion 101 side. The optical members 1033 transmit the laser light LB that is radiated from the light sources 1011. The optical member 1033 is a plate-shaped member that includes plural optical elements 1034 (an example of an optical diffusing portion) on the surface (hereinafter, referred to as a surface to be irradiated) of a side opposite to the radiating portion 101. As shown in FIG. 5, the optical elements 1034 are arranged along the width direction. In the cross-section of the optical element 1034 having the transporting direction as a normal direction, the radiation portion 101 side of the optical elements 1034 is formed in a convex shape. In addition, as shown in FIG. 6, each of the optical elements 1034 extends along the transporting direction. The surface of the optical member 1033 side opposite to the transport path r is formed in a plane in order to easily remove the attached dust or toner. In this example, the optical elements 1034 are a cylindrical lens, and the optical member 1033 is a lenticular lens. The plural optical elements 1034 may be integrally molded and form the optical member 1033, and the plural optical elements 1034 may be bonded to each other and form the optical member 1033.

In the surface to be irradiated, a region that is irradiated by the laser light LB is referred to as a region to be irradiated. The laser light LB is diffused in the width direction and is converged in the transporting direction by the luminous flux diffusing members 1031 and the luminous flux converging members 1032 before propagating to the optical member 1033. Thereby, as shown in FIG. 6, a region to be irradiated S1 is formed in an elliptical shape that has the width direction as a long diameter r1 and the transporting direction as a short diameter r2. The laser light LB that is radiated to the region to be irradiated S1 is transmitted through the optical member 1033. Hereinafter, in the optical member 1033, a three-dimensional region through which the laser light LB is transmitted is referred to as a transmission region. Since there are four light sources 1011 radiating the laser light LB toward the optical member 1033, the optical member 1033 includes four regions to be irradiated S1 and four transmission regions V1. Plural optical elements 1034 are included in the transmission region V1. A pitch p of the optical elements 1034 is shorter than the interval d of the light source 1011.

Figure 7:
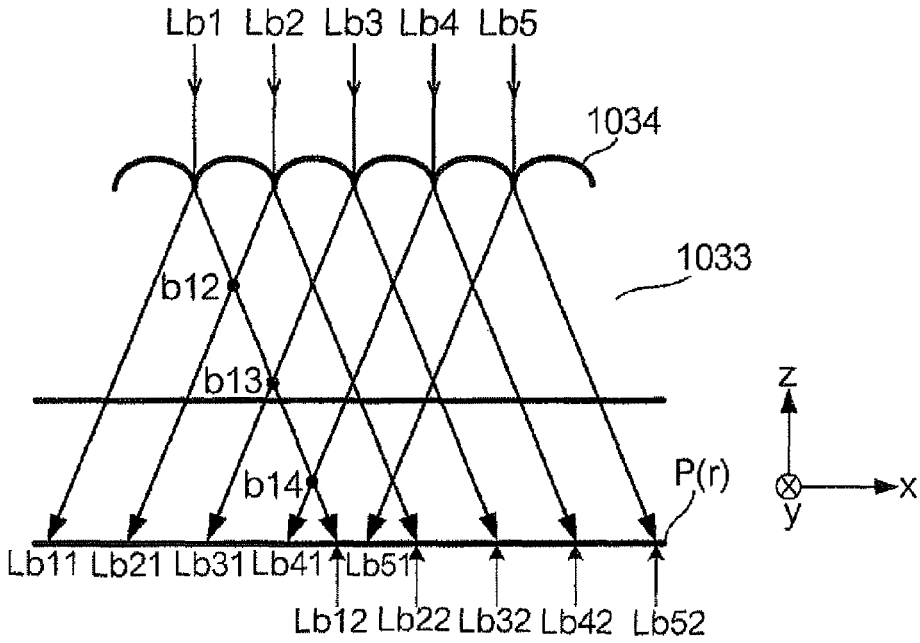
FIG. 7 is a view of a state where laser light enters the optical member when viewed from the upstream side in the transporting direction.
Figure 8:
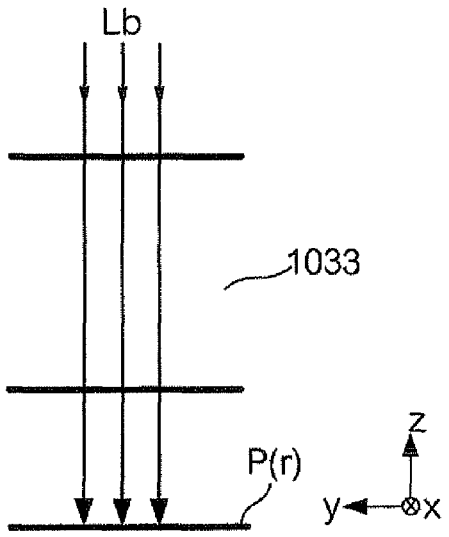
FIG. 8 is a view of the state where the laser light enters the optical member when viewed from the one side in the width direction.

FIG. 7 is a view of a state where the laser light LB enters the optical member 1033 when viewed from the upstream side in the transporting direction. FIG. 8 is a view of the state where the laser light LB enters the optical member 1033 when viewed from the one side in the width direction. FIGS. 7 and 8 show a direction in which plural light rays Lb that are included in the laser light LB propagate. Since the laser light LB radiated from the light sources 1011 has a solid angle, substantially, all light rays Lb do not vertically enter the region to be irradiated S1. However, here, the light rays Lb vertically entering the region to be irradiated is described. As shown in FIG. 7, the light rays Lb are diffused in the width direction to the optical elements 1034. In addition, the light rays Lb that are diffused by the optical elements 1034 intersect with the light rays Lb that are diffused by the other optical elements 1034. In the example shown in FIG. 7, the light ray Lb12 that is generated by the diffusion of the light ray Lb1 intersects at points b12, b13, and b14 with each of the light ray Lb21 generated by the diffusion of the light ray Lb2, the light ray Lb31 generated by the diffusion of the light ray Lb3, and the light ray Lb41 generated by the diffusion of the light ray Lb4 until the light ray Lb12 reaches the transport path r. Thereby, homogeneity in the width direction of the light rays Lb that are diffused by each of the plural optical elements 1034 becomes higher compared to the homogeneity in the width direction of the light rays before being diffused by the optical elements 1034. In addition, in FIG. 7, only the light rays Lb that enter the boundaries of two optical elements 1034 adjacent to each other are shown. However, the light rays Lb may enter any portion of the surfaces of the convex shapes of the optical elements 1034 and may be diffused. On the other hand, as shown in FIG. 8, in the optical member 1033, the cross-section having the width direction as a normal direction is a rectangular shape. Therefore, the light rays Lb are transmitted through the optical elements 1034 without being refracted in the transporting direction.

Referring to FIGS. 3 and 4 again, if the light rays Lb are diffused at each of the optical elements 1034, the laser light LB is diffused in the transporting direction. As shown in FIG.

3, the laser light LB is transmitted through the transmission regions V1 of the optical member 1033 and is diffused in the width direction. The laser light LB diffused by the optical member 1033 is radiated to radiation regions R1 that extend in the width direction on the transport path r. As described above, the homogeneity in the width direction of the diffused light rays Lb becomes higher compared to the homogeneity of the light rays before being diffused. Thereby, the homogeneity in the width direction of the laser light LB that is diffused by the optical member 1033 is higher than the homogeneity in the width direction of the laser light LB before being diffused by the optical member 1033. On the other hand, as shown in FIG. 4, the laser light LB is transmitted through the optical member 1033 without being refracted in the transporting direction.

The housing 102 supports the optical member 1033 in the opening 1022. The optical member 1033 is supported to the housing 102, and therefore, the opening 1022 is covered. A portion of the toner heated by the laser light LB is sublimated and becomes a gas, and the gas is cooled and dust may be generated. If the opening 1022 is covered by the optical member 1033, the entering of dust to the inner portion of the housing 102 is prevented.

MODIFICATION

The present invention is not limited to the above-described exemplary embodiment, and various modifications may be performed. Hereinafter, some modifications will be described. Among the modifications described below, two or more may be combined and be used.

(1) First Modification

The shapes of the optical elements 1034 at the radiating portion 101 side are not limited to the convex shape. The shapes of the optical elements 1034 may be any shape if having a shape that diffuses the light rays Lb in the width direction. For example, the optical elements 1034 may be formed in a concave shape.

Figure 9:
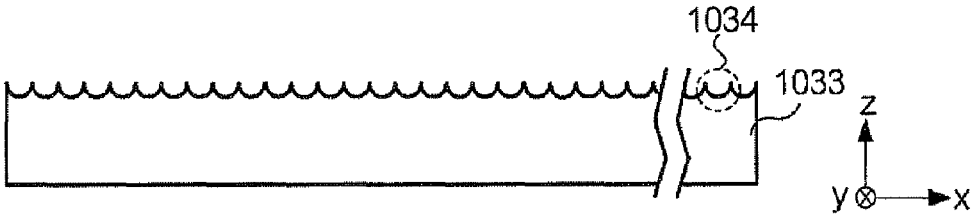
FIG. 9 is an enlarged view of a cross-section having a transporting direction of an optical member according to a first modification as a normal direction.

FIG. 9 is an enlarged view of a cross-section having the transporting direction of the optical member 1033 according to a first modification as a normal direction. The optical member 1033 includes plural optical elements 1034 that are arranged on the surface to be irradiated along the width direction. The radiating portion 101 side of the optical elements 1034 is formed in a concave shape in the cross-section having the transporting direction as a normal direction. The optical elements 1034 are a plane-concave lens extending along the transporting direction.

(2) Second Modification

The direction in which the optical member 1033 diffuses the laser light LB is not limited to the width direction. The optical member 1033 may diffuse the laser light LB in the transporting direction in addition to the width direction. In this case, the optical member 1033 includes other plural light diffusion portions instead of the plural optical elements 1034, and the other light diffusion portions diffuse the laser light LB in the width direction and the transporting direction. Hereinafter, two examples of the light diffusion portions instead of the optical elements 1034 will be described.

Figure 10:
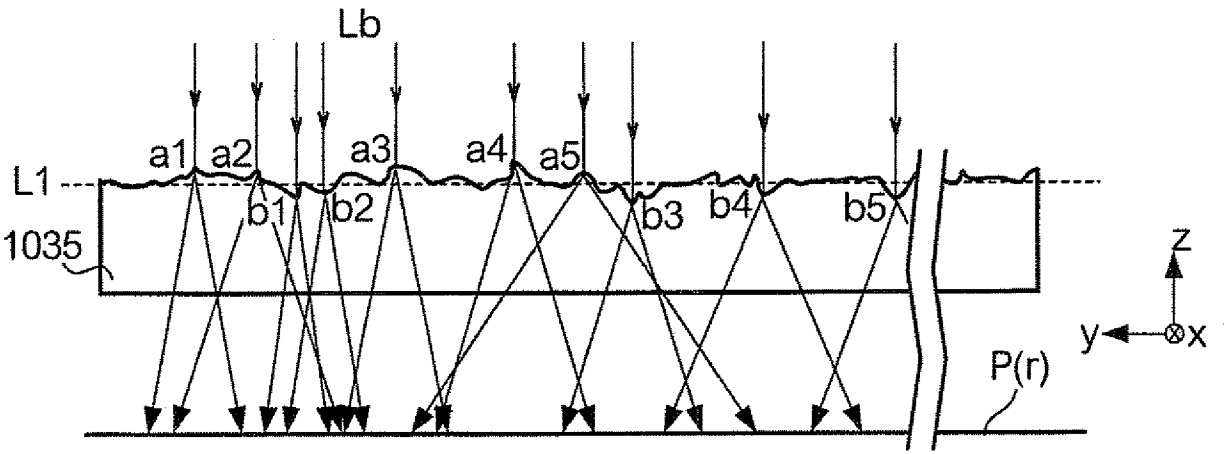
FIG. 10 is an enlarged view of a cross-section having a width direction of an optical member according to a second modification as a normal direction.

FIG. 10 is an enlarged view of a cross-section having the width direction of optical member 1035 according to a second modification as a normal direction. FIG. 10 shows an example in which a frosted glass is used as the optical member 1035. Plural irregularities are irregularly formed on the surface of the frosted glass to be irradiated. In the example of FIG. 10, the plural irregularities correspond to the light diffusion portion. A broken line L1 indicates an average of the heights of the plural irregularities. Here, among the plural irregularities, peaks which are higher than the value determined from the height of the broken line L1 are expressed as convex portions, and valleys which are lower than the value determined from the height of the broken line L1 are expressed as concave portions. In FIG. 10, a point a (a1 to a5) indicates apexes of the convex portions and a point b (b1 to b5) indicates apexes of the concave portions. An average interval of convex portions (or concave portions) adjacent to each other in the transporting direction or the width direction is shorter than the interval d of the light sources 1011. FIG. 10 shows the cross-section having the transporting direction of the optical member 1035 as a normal direction. If the light rays Lb enter the region to be irradiated S1, the light rays Lb are diffused by the irregularities. The plural irregularities irregularly diffuse the light rays Lb in the width direction and the transporting direction. The light ray Lb that is diffused by one convex portion or one concave portion intersects with the light rays Lb that are diffused by other convex portions or other concave portions. Thereby, the uniformity in the width direction and the transporting direction of the light rays Lb that are diffused by the irregularities of the optical member 1035 becomes higher than the uniformity in the width direction and the transporting direction of the light rays before being diffused by the irregularities. In addition, in FIG. 10, only the light rays Lb entering the apexes of the convex portions and the concave portions are shown. However, the light rays Lb may enter any portion of the surface of the optical member 1035 to be irradiated and may be diffused.

Figure 11:
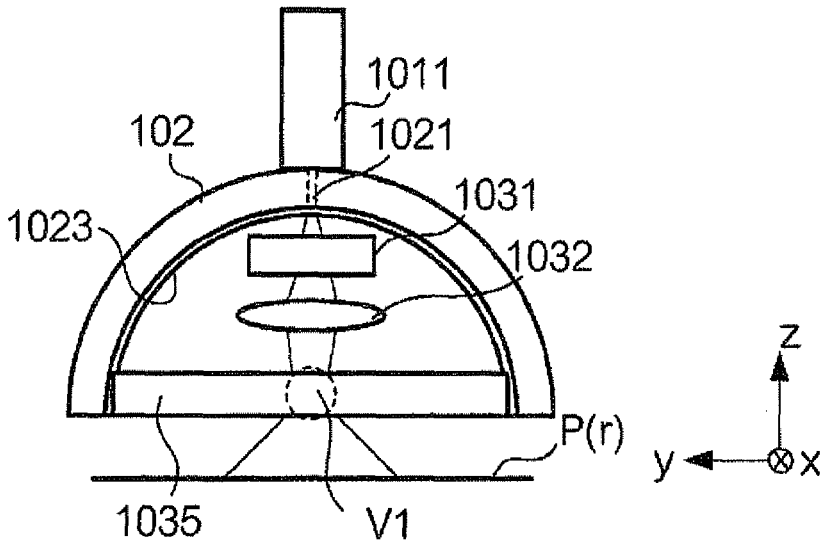
FIG. 11 is a view of a fixing device using the optical member according to the second modification when viewed from one side in the width direction.

FIG. 11 is a view of the fixing device 10 using the optical member 1035 according when viewed from one side in the width direction. FIG. 11 is different from FIG. 4 in that the optical member 1035 is a frosted glass. The laser light LB is transmitted through the transmission region V1 of the optical member 1035, and therefore, the laser light are diffused in the width direction and the transporting direction. If the laser light LB is diffused in the transporting direction, the time during which the laser light LB irradiates the paper P is longer than the case where the laser light LB is not diffused in the transporting direction. In addition, as described above, the uniformity in the width direction and the transporting direction of the light rays Lb that are diffused by the irregularities becomes higher compared to the uniformity of the light rays before being diffused by irregularities. Thereby, the uniformity in the width direction and the transporting direction of the laser light LB that is diffused by the optical member 1035 become higher than the uniformity in the width direction and the transporting direction of the laser light before being diffused by the optical member 1035. The cross-sectional view of the fixing device 10 using the optical member 1035 when viewed from the upstream side in the transporting direction is similar to FIG. 3.

Figure 12:
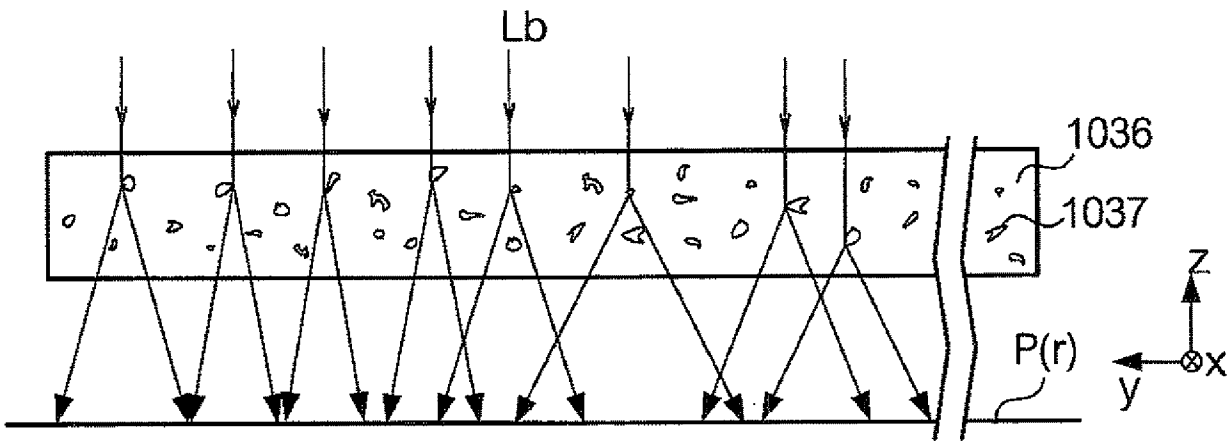
FIG. 12 is an enlarged view of a cross-section having the width direction of the optical member according to the second modification as a normal direction.

FIG. 12 is an enlarged view of a cross-section having the width direction of the optical member 1036 according to the second modification as a normal direction. FIG. 12 shows an example that uses an opal glass as the optical member 1036. Plural light diffusion materials 1037 are mixed in the inner portion of the opal glass, and the plural light diffusion materials 1037 are included in the transmission region V1. The light diffusion materials 1037 diffuse the light rays Lb that enter the region to be irradiated S1. The light diffusion materials 1037 irregularly diffuse the light rays Lb in the width direction and the transporting direction. In the example of FIG. 12, plural light diffusion materials 1037 correspond to the light diffusion portions. The average interval of the light diffusion materials 1037 adjacent to each other is shorter than the interval d of the light sources 1011. The cross-section of the optical member 1036 having the transporting direction as a normal direction is similar to FIG. 12. The light rays Lb that are diffused by one light diffusion material 1037 intersect with the light rays Lb that are diffused by other light diffusion materials 1037. Thereby, the uniformity in the width direction and the transporting direction of the light rays Lb diffused by the light diffusion materials 1037 become higher compared to the uniformity in the width direction and the transporting direction of the light rays before being diffused by the light diffusion materials 1037. In addition, the light rays Lb are not limited to those shown in FIG. 12. The light rays Lb may enter any portion of the surface to be irradiated of the optical member 1036 and may be diffused. In the fixing device 10 using the optical member 1036, since an aspect in which the laser light LB is diffused in the width direction and the transporting direction is similar to that of FIG. 11, the description is omitted.

(3) Third Modification

The radiating portion 101 is not limited to a single one. The fixing device 10 may include plural radiating portions 101. In this case, the length in the transporting direction of the radiation regions in which one radiation portion 101 radiates the laser light LB may be different from the length in the transporting direction of the radiation regions in which other radiation portions 101 radiate the laser light LB. For example, the length of the transporting direction of the radiation regions is determined by a kind of the optical member. Hereinafter, the portions different from the exemplary embodiment will be mainly described with respect to the fixing device 10 according to the third modification.

Figure 13:
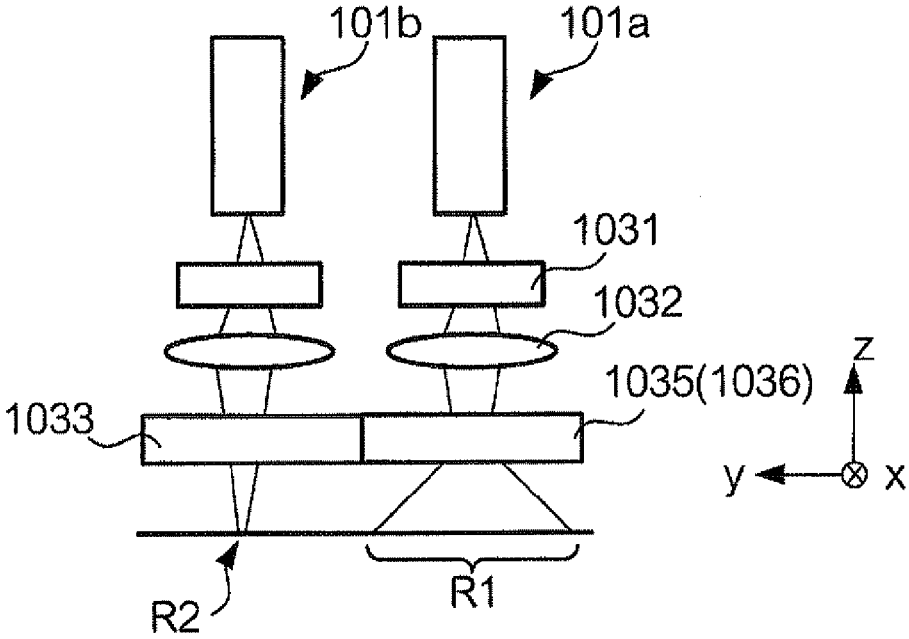
FIG. 13 is a view of a fixing device according to a third modification when viewed from one side in the width direction.

FIG. 13 is a view of the fixing device 10 according to the third modification when viewed from one side in the width direction. In the third modification, the fixing device 10 includes a radiating portion 101*a* (an example of a first radiating portion) and a radiating portion 101*b* (an example of a second radiating portion). In addition, the housing 102 is not shown. The laser light LB that is radiated from the radiating portion 101*a* is transmitted through the optical member 1035 (or optical member 1036) and, is radiated to the radiating region R1. The laser light LB that is radiated from the radiating portion 101*b* is transmitted through the optical member 1033 and is radiated to the radiating region R2. The time during which the radiating portion 101 radiates the laser light LB on a region of the paper P is determined by the length in the transporting direction of the radiation region R. In FIG. 13, since the laser light LB is diffused in the transporting direction, the length in the transporting direction of the radiation region R1 is longer than the length in the transporting direction of the radiation region R2. Therefore, a first time during which the radiating portion 101*a* radiates the laser light LB on a region of the paper P is longer than a second time during which the radiating portion 101*b* radiates the laser light LB on a region of the paper P. In this way, if plural radiation regions R in which the lengths in the transporting direction are different from one another are provided, even in any region of a region in which the toner density has a higher value than a value and a region in which the toner density has a lower value than a value, compared to the case the radiation region R is single, the toner image is favorably fixed to the paper P. In addition, the fixing device shown in FIG. 13 is configured so that the radiation region R1 having the longer length in the transporting direction is disposed further upstream than the radiation region R2 having the shorter length in the transporting direction. In this case, compared to a configuration in which the radiation region R2 is disposed further upstream than the radiation region R1, the toner image is favorably fixed to the paper P.

(4) Fourth Modification

The configuration of the optical system 103 is not limited to the configuration described in the exemplary embodiment. For example, the optical system 103 may be disposed between the radiating portion 101 and the transport path r while having an order different from that of the exemplary embodiment.

Figure 14:
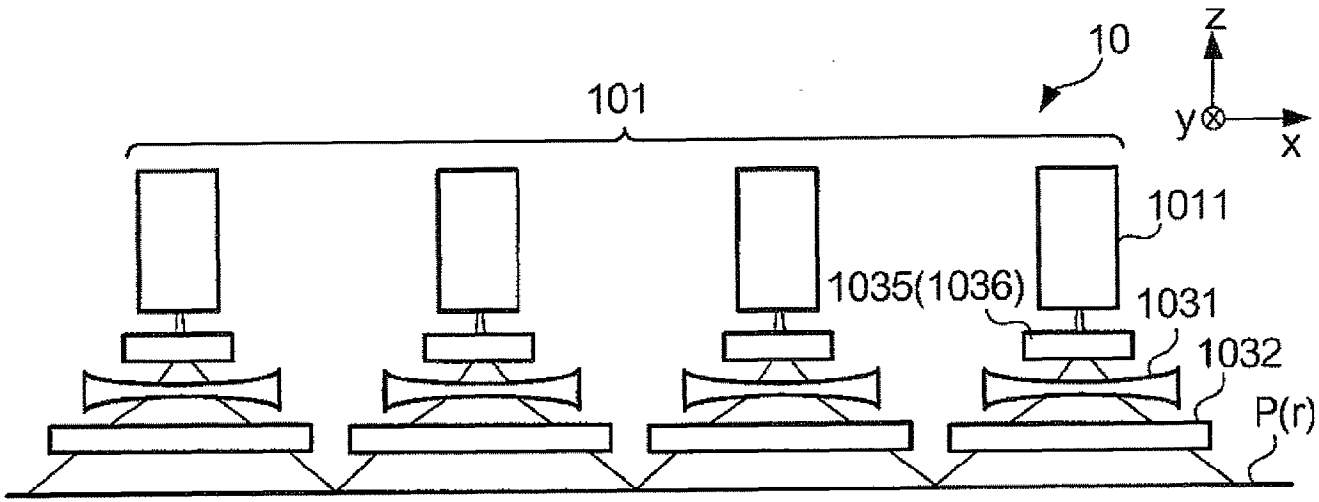
FIG. 14 is a cross-sectional view of a fixing device according to a fourth modification when viewed from the upstream side in the transporting direction.
Figure 15:
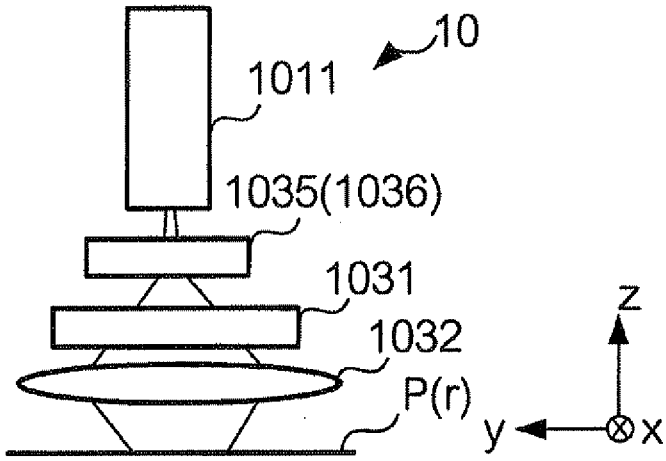
FIG. 15 is a view of the fixing device according to the fourth modification when viewed from the one side in the width direction.

FIG. 14 is a cross-sectional view of the fixing device 10 according to a fourth modification when viewed from the upstream side in the transporting direction. FIG. 15 is a view of the fixing device 10 according to the fourth modification when viewed from the one side in the width direction. In addition, the housing 102 is not shown. In the fourth modification, the laser light LB radiated from the light sources 1011 propagates toward the optical member 1035 (or optical member 1035). Other members through which the light is transmitted are not present between the light sources 1011 and the optical member 1035. The optical member 1035 diffuses the laser light LB in the width direction and the transporting direction before the laser light LB is transmitted through the luminous flux diffusing members 1031 and the luminous flux converging members 1032. In other words, the laser light LB is transmitted through the luminous flux diffusing members 1031 and the luminous flux converging members 1032 after being transmitted through the optical member 1035. In this case, compared to the case where the optical member 1035 diffuses the laser light LB after the laser light LB is transmitted through the luminous flux diffusing members 1031 and the luminous flux converging members 1032, since the area of the region to be radiated S1 is decreased, the optical member 1035 configuring the fixing device 10 also becomes smaller. Moreover, in another example, the optical system 103 may include only the optical member 1035.

(5) Other Modifications

The pitch p of the optical elements 1034 is not limited to that described in the exemplary embodiment. The pitch p of the optical elements 1034 may be shorter than the long diameter r1 of the region to be radiated S1. In the same way, the average interval of the convex portions (or concave portions) that are adjacent to each other in the second modification may be shorter than the long diameter r1. In addition, the average interval of the light diffusion materials 1037 that are adjacent to each other may be shorter than the long diameter r1.

In the exemplary embodiment, the example where the image forming apparatus 100 is a copying machine is shown. However, the image forming apparatus may be an apparatus which receives data of a bitmap format or a vector format from the outside via a communication IF6 and an image is formed based on the data.

In the exemplary embodiment, the example where the paper P is the continuous paper is shown. However, the paper P may be one that is cut for each page according to the determined size.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first radiating portion that (1) includes a plurality of light sources arranged along a first direction at a determined interval, and (2) radiates light on a recording medium on which a toner image is formed, the recording medium being transported in a second direction intersecting with the first direction; and an optical member that includes (a) a plurality of transmission regions through which the light radiated by the plurality of light sources is transmitted, and (b) a plurality of light diffusion portions that are on each of the plurality of transmission regions, that diffuse the light in the first direction, and that each extend farther in the second direction than in the first direction.

2. The fixing device according to claim 1, wherein the plurality of light diffusion portions are a plurality of optical elements that are arranged in the first direction, and a pitch of the plurality of optical elements is shorter than an interval of the plurality of light sources.

3. The fixing device according to claim 2, further comprising:

a housing that is provided with (1) an opening that is opposite to a transporting path on which the recording medium is transported and that allows the light radiated by the plurality of light sources and light reflected by the recording medium to pass through, and (2) a reflective surface that causes the reflected light passing through the opening to be reflected on the recording medium, and wherein the optical member covers the opening.

4. The fixing device according to claim 1, wherein the light diffusion portions diffuse the light radiated by the first radiating portion in the second direction.

5. The fixing device according to claim 4, wherein the plurality of light diffusion portions are a plurality of irregularities that are formed on the surface of the optical member, and an average interval of convex portions adjacent to each other among the plurality of irregularities is shorter than an interval of the plurality of light sources.

6. The fixing device according to claim 5, further wherein:

the light radiated by the first radiating portion is first light, the fixing device further comprises a second radiating portion that radiates the second light on the recording medium to which the first light is radiated by the first radiating portion, the first radiating portion radiates the first light on the recording medium for a first time, and the second radiating portion radiates the second light on the recording medium for a second time that is shorter than the first time.

7. The fixing device according to claim 6, further comprising:

a housing that is provided with (1) an opening that is opposite to a transporting path on which the recording medium is transported and that allows the first light, second light, and light reflected by the recording medium to pass through, and (2) a reflective surface that causes the reflected light passing through the opening to be reflected on the recording medium, and wherein the optical member covers the opening.

8. The fixing device according to claim 5, further comprising:

a housing that is provided with (1) an opening that is opposite to a transporting path on which the recording medium is transported and that allows the light radiated by the plurality of light sources and light reflected by the recording medium to pass through, and (2) a reflective surface that causes the reflected light passing through the opening to be reflected on the recording medium, and wherein the optical member covers the opening.

9. The fixing device according to claim 4, wherein the plurality of light diffusion portions are a plurality of light diffusion materials that are mixed into the inner portion of the optical member and that diffuse the light, and an average interval of the light diffusion materials adjacent to each other among the plurality of light diffusion materials is shorter than an interval of the plurality of light sources.

10. The fixing device according to claim 9, wherein:

the light radiated by the first radiating portion is first light, the fixing device further comprises a second radiating portion that radiates second light on the recording medium to which the first light is radiated by the first radiating portion, the first radiating portion radiates the first light on the recording medium for a first time, and the second radiating portion radiates the second light on the recording medium for a second time that is shorter than the first time.

11. The fixing device according to claim 10, further comprising:

a housing that is provided with (1) an opening that is opposite to a transporting path on which the recording medium is transported and that allows the first light, the second light, and light reflected by the recording medium to pass through, and (2) a reflective surface that causes the reflected light passing through the opening to be reflected on the recording medium, and wherein the optical member covers the opening.

12. The fixing device according to claim 9, further comprising:

a housing that is provided with (1) an opening that is opposite to a transporting path on which the recording medium is transported and that allows the light radiated by the plurality of light sources and light reflected by the recording medium to pass through, and (2) a reflective surface that causes the reflected light passing through the opening to be reflected on the recording medium, and wherein the optical member covers the opening.

13. The fixing device according to claim 4, wherein:

the light radiated by the first radiating portion is first light, the fixing device further comprises a second radiating portion that radiates the second light on the recording medium to which the first light is radiated by the first radiating portion, the first radiating portion radiates the first light on the recording medium for a first time, and the second radiating portion radiates the second light on the recording medium for a second time that is shorter than the first time.

14. The fixing device according to claim 13, further comprising:

a housing that is provided with (1) an opening that is opposite to a transporting path on which the recording medium is transported and that allows the first light, the second light, and light reflected by the recording medium to pass through, and (2) a reflective surface that causes the reflected light passing through the opening to be reflected on the recording medium, and wherein the optical member covers the opening.

15. The fixing device according to claim 4, further comprising:

a housing that is provided with (1) an opening that is opposite to a transporting path on which the recording medium is transported and that allows the light radiated by the plurality of light sources and light reflected by the recording medium to pass through, and (2) a reflective surface that causes the reflected light passing through the opening to be reflected on the recording medium, and wherein the optical member covers the opening.

16. The fixing device according to claim 1, further comprising:

a housing that is provided with (1) an opening that is opposite to a transporting path on which the recording medium is transported and that allows the light radiated by the plurality of light sources and light reflected by the recording medium to pass through, and (2) a reflective surface that causes the reflected light passing through the opening to be reflected on the recording medium, and wherein the optical member covers the opening.

17. The fixing device according to claim 1, wherein other members through which the light is transmitted are not present between the optical member and the first radiating portion.

18. An image forming apparatus comprising:

a transfer portion that transfers a toner image on a recording medium; and the fixing device according to claim 1 that fixes toner on the recording medium to which the toner image is transferred by the transfer portion.

19. The fixing device according to claim 1, wherein the plurality of light diffusion portions refract the light in the first direction so as to diffuse the light in the first direction.

* * * * *